US007063037B1

(12) United States Patent
Parks

(10) Patent No.: US 7,063,037 B1
(45) Date of Patent: Jun. 20, 2006

(54) MULTIPURPOSE MARINE SAFETY STORAGE SYSTEM

(76) Inventor: Brian Thomas Parks, 2532 14th Ave., Seattle, WA (US) 98119

( * ) Notice: Subject to any disclaimer, the term of this patent is extended or adjusted under 35 U.S.C. 154(b) by 0 days.

(21) Appl. No.: 10/906,843

(22) Filed: Mar. 9, 2005

Related U.S. Application Data

(60) Provisional application No. 60/628,706, filed on Nov. 17, 2004.

(51) Int. Cl.
*B63B 17/00* (2006.01)

(52) U.S. Cl. ..... 114/361; 114/343

(58) Field of Classification Search ..... 114/343, 114/347, 361, 363, 364; 383/12, 34.1
See application file for complete search history.

(56) References Cited

U.S. PATENT DOCUMENTS

| | | | | |
|---|---|---|---|---|
| 2,805,430 | A | 9/1957 | Philbrick | |
| 4,099,656 | A | 7/1978 | Neumann et al. | |
| 4,724,791 | A * | 2/1988 | McSorley | 114/343 |
| 4,756,455 | A | 7/1988 | Kitner et al. | |
| 4,844,307 | A | 7/1989 | Rutledge | |
| 5,076,711 | A | 12/1991 | Koehler, Jr. | |
| 5,605,112 | A | 2/1997 | Schuman | |
| 5,797,528 | A | 8/1998 | McDuffie | |
| 6,092,702 | A | 7/2000 | Cassidy, IV | |
| 6,257,261 | B1 | 7/2001 | Johnson | |
| 6,276,383 | B1 | 8/2001 | Galstad | |
| 6,327,993 | B1 | 12/2001 | Richens, Jr. | |
| 6,345,744 | B1 | 2/2002 | Eldridge | |
| 6,575,626 | B1 | 6/2003 | Gillespie, Jr. et al. | |
| 6,725,799 | B1 | 4/2004 | Tull | |
| 6,863,016 | B1 * | 3/2005 | Biemiller | 114/361 |

* cited by examiner

*Primary Examiner*—Lars A. Olson
(74) *Attorney, Agent, or Firm*—Stites & Harbison PLLC; John E. Vanderburgh

(57) ABSTRACT

A multipurpose marine safety storage system includes a safety storage unit for containing emergency/safety gear and which is adapted for quick release attachment to a marine craft. The safety storage system includes a storage unit having attachment locations for the attachment of modular containers for miscellaneous safety and personal items. The system is adapted for flotation by the incorporation in the storage unit of the sheet of buoyant material such as closed cell foam or an inflatable bladder so that the system serves as a flotation device as well as a container for bulky items such as life jackets. In the preferred embodiment the multipurpose storage system is secured on the undersurface of a cockpit cover so that items contained in the safety storage unit and modular containers are stored overhead and out-of-the-way yet are conveniently and instantly available in the event of an emergency. At least one surface of the safety storage unit of the system is provided with SOLAS grade reflective tape to enhance day and night visibility for search and rescue.

20 Claims, 5 Drawing Sheets

MULTIPURPOSE MARINE SAFETY STORAGE SYSTEM

CROSS REFERENCE TO RELATED APPLICATION

This application claims the benefit of the filing date of provisional application 60/628,706, filed Nov. 17, 2004, in the name of Brian Parks, entitled MARINE STORAGE DEVICE, the content of which are incorporated by reference herein.

FIELD OF THE INVENTION

This invention relates to the field of marine safety equipment and containers for storing items and more particularly to a multipurpose system for both storing items such as life jackets on small marine craft and serving as an emergency floatation device in the event of a marine emergency.

BACKGROUND OF THE INVENTION

Marine craft such as recreational sailboats, outboard and inboard powerboats, fishing party boats and the like have limited storage space for emergency equipment such as life jackets, flotation devices and the like. Although regulations require that such equipment be carried on board it is often stored in areas that are not readily accessible and in the event of an emergency precious time is lost in reaching the emergency equipment.

Normally such boats include a cockpit area for the operator and passengers and normally have limited deck space. In many cases the cockpit is covered by a canopy which consists of a hard or soft top carried by a suitable frame member that is attached to the boat. These covers are often referred to as bimini covers or hardtops. The cockpit cover may overlie only a portion of or the entire cockpit area and they are normally raised sufficiently high above the cockpit to permit the occupants to stand upright underneath the cover.

Storage space on small boats is limited and often consists of a relatively limited glove box storage area and, depending upon the type of boat, an under the bow storage area. Thus storage space is at a premium. It is a requirement that life jackets be carried on board for occupants of the boat. With the limited storage space available on small craft, the life jackets are often stowed in areas such as under the bow or under the lounge seating or in some cases lying loose in the passenger compartment. Often due to their storage location the life jackets may not be readily accessible in the event of an emergency and depending on how they are stowed the life jackets can become soiled or damaged. Normally other types of flotation devices such as a raft or similar flotation device which are useful in keeping passengers and crew together in the event of an emergency are not carried on the small recreational type craft. Other small items such as small emergency radios, flares, first aid kits and other personal items such as sunscreen and the like that may be carried on board also can present a storage problem.

Various solutions to storage problems have been proposed. For example a life preserver storage unit that doubles as a seat is described in U.S. Pat. No. 2,805,430. An overhead storage bag is described in U.S. Pat. No. 6,327,993. However, the overhead storage bag comprises a series of storage pockets that are too small for life jacket storage and furthermore the storage unit is not suitable for use as a flotation device in the event of an emergency.

The safety storage system comprises a generally rectangular storage unit having a facing section and a corresponding rear section joined along their longitudinal and lateral edges to define an interior between the joined sections. The facing section is provided with an opening that runs substantially the length of the section for access to the interior of the storage bag. A panel secured at one end to the storage unit overlies the opening for opening and closing the unit. The panel is provided with suitable closure means to secure the panel in the closed position but which can be easily reached from the cockpit area to release the panel quickly for access to the interior of the storage unit in the event of an emergency. Hand holds are disposed on the longitudinal and lateral edges of the safety storage unit for ease of handling the storage unit and for securing the safety storage system to a marine craft. In the preferred embodiment, the storage unit is attached to fore and aft support rods of the cockpit cover and underlies the inner face of the cockpit cover for overhead storage of life jackets and the like. The safety storage unit of the invention serves as an off-boat flotation device by the insertion of a flotation component in the interior of the storage unit, such as a closed cell foam sheet, an inflatable bladder or the like, to provide buoyancy for the safety storage system making it suitable for use as a flotation device in the event of an emergency.

The present invention provides a safety storage system for life jackets and other bulky items which may be difficult to properly store. The multipurpose marine safety storage system is particularly suited for overhead storage and can be used with any type of cockpit cover, including bimini tops of various designs. The safety storage system of the invention is additionally adapted for the storage of miscellaneous smaller items so that the cockpit area is clear and the life jackets as well as the miscellaneous items are readily assessable and organized. The safety storage system of the invention is adapted to be mounted on the underside of the cockpit cover so that its facing surface is exposed to the cockpit area and its rear surface is contiguous with the undersurface of the cockpit cover.

SUMMARY OF THE INVENTION

The present invention relates to an improve safety storage system for items on a marine craft, such as sailboats, outboard and inboard powerboats, fishing party boats and the like, where storage space is at a premium. In accordance with the invention the safety storage system is adapted to be secured on the underside of a cockpit cover so items contained in the unit are overhead and out of the way but within easy reach and readily accessible. The safety storage system can also be secured to other portions of a marine craft, such as the side or transom railings, if no cockpit cover is present.

The safety storage system comprises a generally rectangular storage unit having a facing section and a corresponding rear section joined along their longitudinal and lateral edges to define an interior between the joined sections. The facing section is provided with an opening that runs substantially the length of the section for access to the interior of the storage bag. A panel secured at one end to the storage unit overlies the opening for opening and closing the unit. The panel is provided with suitable closure means to secure the panel in the closed position but which can be easily reached from the cockpit area to release the panel quickly for access to the interior of the storage unit in the event of an emergency. Hand holds are disposed on the longitudinal and lateral edges of the safety storage unit for ease of handling the storage unit and for securing the safety storage system to a marine craft. In the preferred embodiment, the storage unit is attached to fore and aft support rods of the cockpit cover and underlies the inner face of the cockpit cover for overhead storage of life jackets and the like. The interior of the storage unit is provided with a foam sheet or an inflatable bladder which provides buoyancy for the safety storage system making it suitable for use as a flotation device in the event of an emergency.

In a preferred embodiment, the storage unit is provided with attachment locations along its edges to which modular containers for miscellaneous articles can be attached. In this manner the safety storage system provides for the convenient overhead storage of such items yet making them readily accessible when needed.

DESCRIPTION OF THE DRAWINGS

As shown in FIGS. 5, 6 and 7, the multipurpose marine safety storage unit 10 is illustrated as attached to the underside of a cockpit cover 50 so that its facing surface is exposed to the cockpit area and its rear surface is contiguous with the undersurface of the cockpit cover. In a preferred embodiment, the storage unit 10 is attached to frame members 52 of the cockpit cover 50 by straps 54 wrapped around a respective frame member 52 with a free end portion passed through a corresponding hand hold 32 and secured to the opposite end portion. One surface of each of the straps 54 is provided with hook and loop material 55 (Velcro®). The straps 54 can be independent of both the frame members 52 and the safety storage unit 10. However, in one embodiment, the straps 54 are secured to the longitudinal and lateral edges of the unit 10 such as by being sewn to the unit or by adhesively bonding.

FIG. 7 is a view from a longitudinal edge of the device of FIG. 1.

DESCRIPTION OF THE INVENTION

The safety storage unit 10 of the multipurpose marine safety storage system is provided with sufficient buoyancy to allow the entire system to float. For example, a foam sheet can be inserted in the storage unit 10 to provide sufficient buoyancy so that the unit can be used to keep personnel together in the water and to prevent them from becoming separated. In a preferred embodiment a sheet of liner material overlies the interior face of the rear section 14 to form a pocket in which the foam liner can be retained. It will be understood, however, that the liner is not a critical component and that the foam sheet can be simply placed in the interior of the unit. It should be noted that not all of the life jackets or similar floatation devices stored in the safety storage unit 10 may utilized and the remaining unused life jackets or floatation devices can be retained in the unit to provide additional buoyancy.

Figure 4:
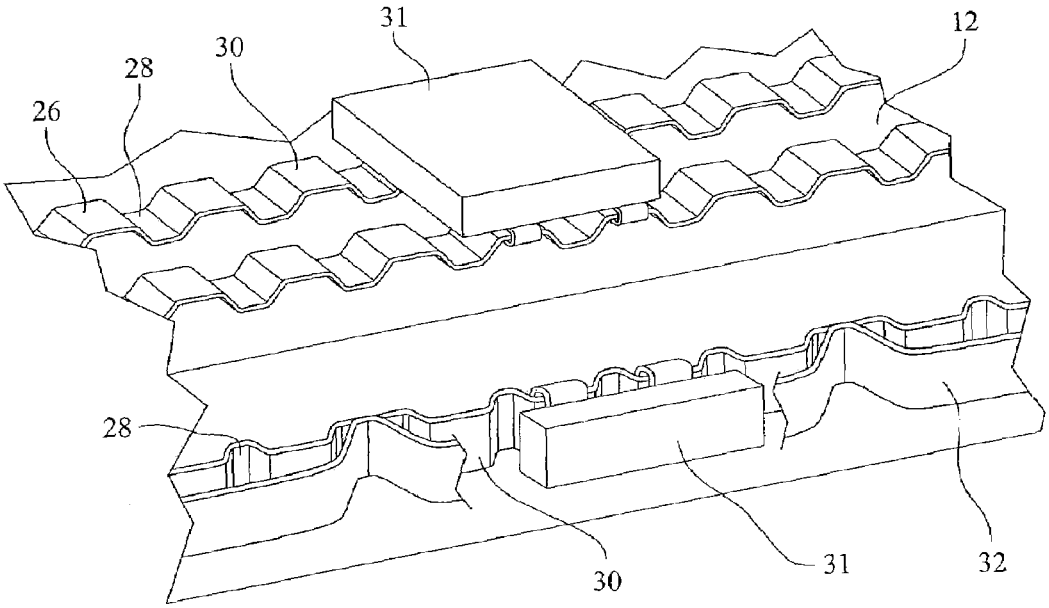
FIG. 4 is a side view of the unit of FIG. 1

The system 10 further includes a strip of web material, referred to as a web ladder 26 secured to the longitudinal and lateral edges of the storage unit 10 and two or more web ladders 26 extend longitudinally on the facing section 12 adjacent each longitudinal edge. As shown most clearly in FIG. 4, the web ladders 26 are secured to the unit 10 at spaced apart intervals 28 so that portions to define their between a plurality of loops 30 that can be used for the attachment of one or more modular containers 31 for the storage of miscellaneous small items such as, for example, smoke units, parachute rocket flares, a first aid kit, a hand-held VHF radio, map containers, GPS equipment, individual strobe lights, personnel locator beacons and the like, all of which are stored in an organized manner out of the way and yet are readily and conveniently accessible when needed. Handholds 32 are also provided around the longitudinal and lateral edges of the storage unit, such as by a second strip of web material secured at intervals so as to define the handholds 32 between the secured portions. As will be explained in more detail below the hand holds also serve to aid in the attachment of the safety storage system to the undersurface of the cockpit cover 50 or other suitable location on board the craft.

Figure 5:
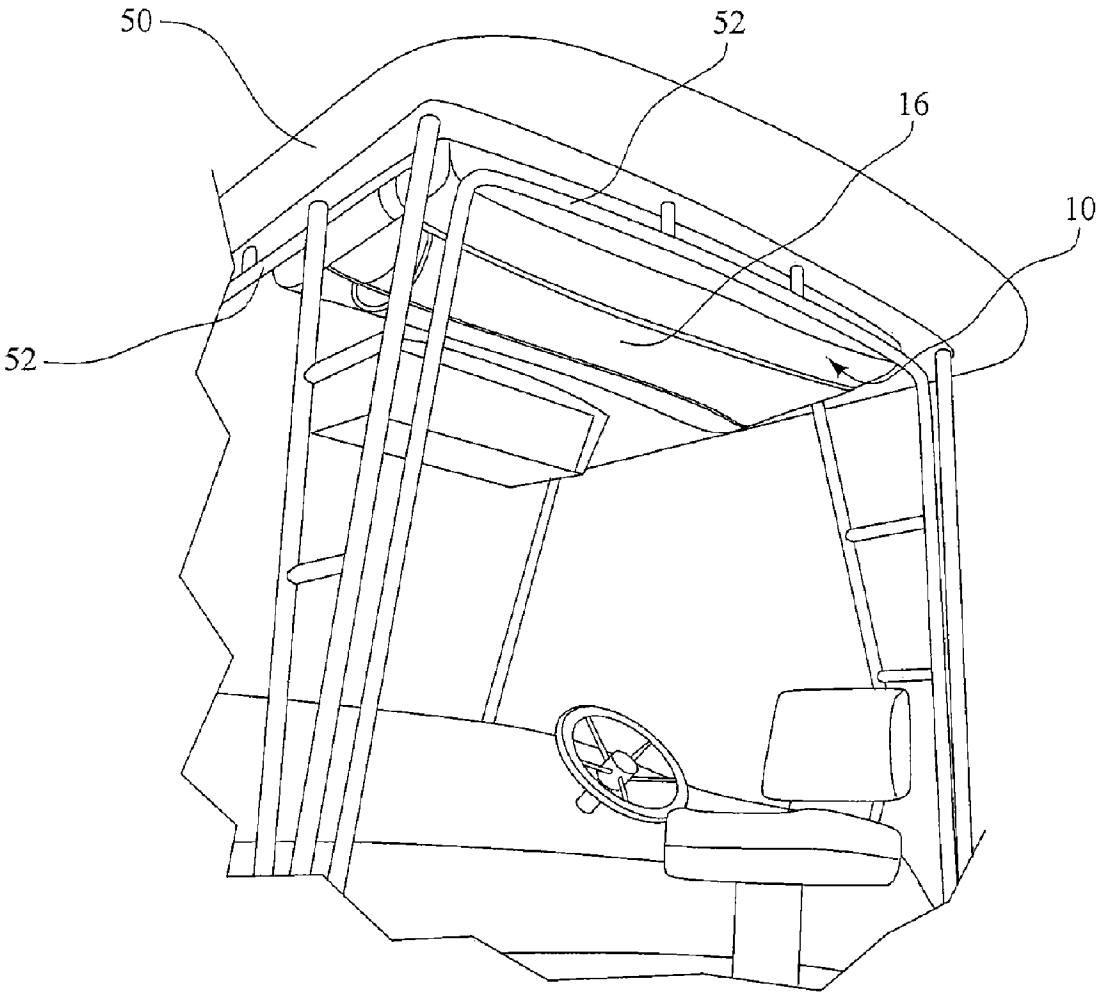
FIG. 5 is a view of the aft end of the unit of FIG. 1.
Figure 6A:
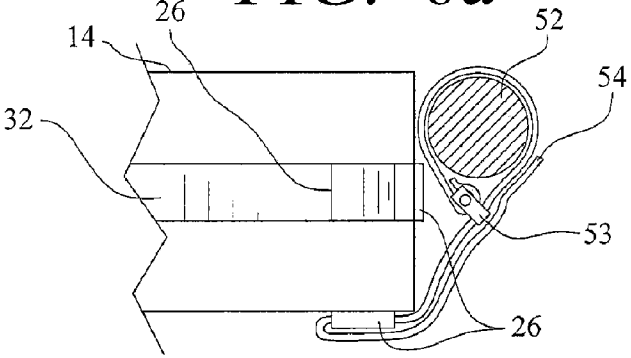
FIG. 6*a* is a portion of the right side of FIG. 6 in enlarged scale and broken away for compactness of illustration.
Figure 6:
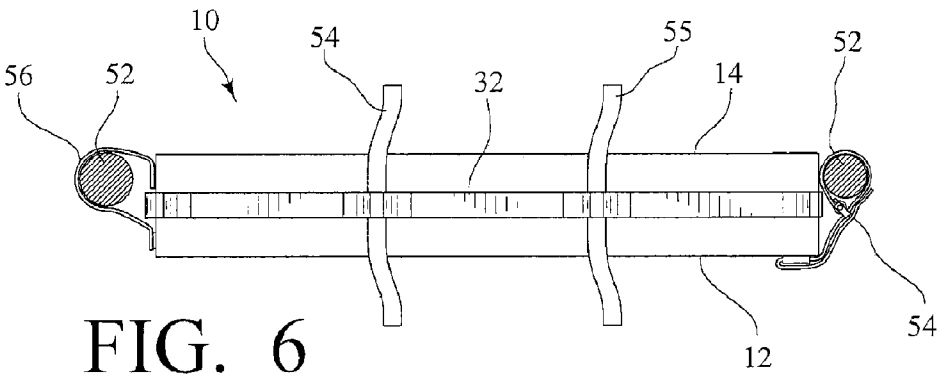
Figure 7:
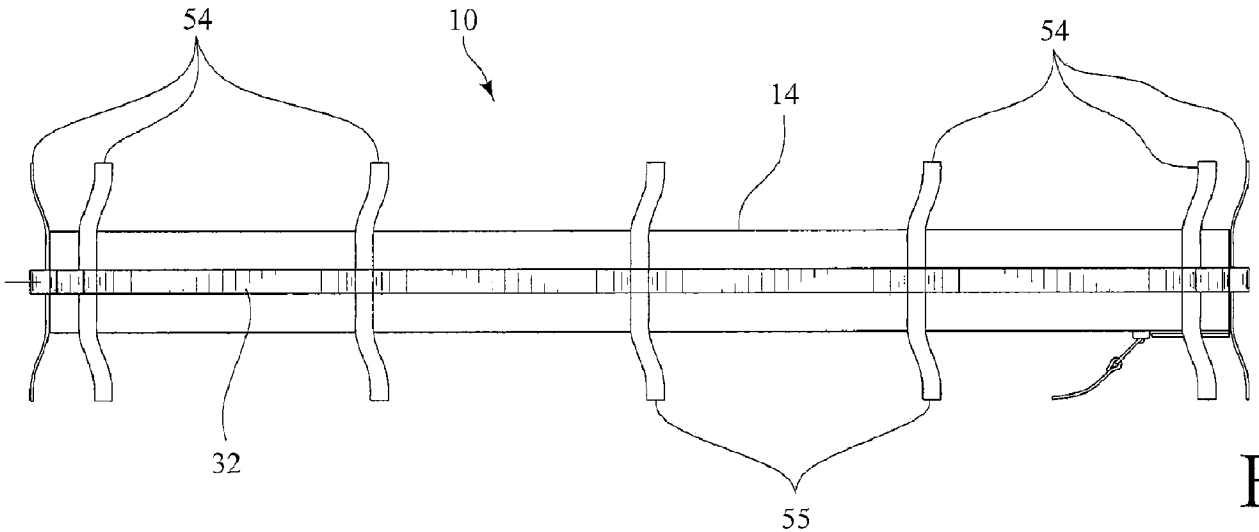

As shown in FIGS. 5, 6 and 7, the multipurpose marine safety storage unit 10 is illustrated as attached to the underside of a cockpit cover 50. In a preferred embodiment, the storage unit 10 is attached to frame members 52 of the cockpit cover 50 by straps 54 wrapped around a respective frame member 52 with a free end portion passed through a corresponding hand hold 32 and secured to the opposite end portion. One surface of each of the straps 54 is provided with hook and loop material 55 (Velcro®). The straps 54 can be independent of both the frame members 52 and the safety storage unit 10. However, in one embodiment, the straps 54 are secured to the longitudinal and lateral edges of the unit 10 such as by being sewn to the unit or by adhesively bonding.

As illustrated, the longitudinal edge of the storage unit 10 facing the bow of the craft is likewise attached to the bow lateral support member of the cockpit cover by the straps 54 or optionally, as illustrated, by a longitudinally running flap 56 formed at the longitudinal edge of the storage unit facing the bow. In this embodiment the longitudinal edge of the storage unit includes a strip 58 of hook and loop material and the outer free end of the flap 56 also contains a strip 40 of corresponding hook and loop material. The flap 56 is passed around the bow lateral support member of the cockpit cover and secured to the strip 38 of Velcro material on the storage unit. The Velcro straps 34 on the lateral edges of the storage unit are passed around the longitudinal support members of the cockpit cover. It should be understood that the straps 54 can be secured to both the longitudinal and lateral edges of the safety storage unit 10. In this embodiment the free hands of the straps 54 are passed around the fore, aft and side frame members 52 supporting the cockpit cover 50 and the opposing end portions secured by the hook and loop material.

The straps 54 can also be used to secure the unit 10 to side or transom rails of a boat in those situations where no cockpit canopy 50 is present or there is adequate deck space to conveniently secure the unit other than on the underside of the cockpit cover. As mentioned, however, it is preferred to attach the multipurpose marine safety storage system to the underside of the cockpit cover 50.

It will be understood that other attachment devices may be employed to secure the safety storage system to the underside of the cockpit cover. For example, clamping devices can be affixed to the longitudinal and lateral edges of the safety storage unit 10 to clamp the edges to the cockpit canopy support members 52. Other attachment devices can be used with good results such as, for example, straps with quick release buckles or stainless snaps. The choice of fastening devices depends on the particular installation requirements for the boat on which the storage unit is to be installed. However, the straps 54 are preferred is they can be quickly released in the event of an emergency in which the multipurpose marine safety storage system is to be employed as a flotation device.

The safety storage unit 10 of the multipurpose marine safety storage system is provided with sufficient buoyancy to allow the entire system to float. For example, a foam sheet can be inserted in the storage unit 10 to provide sufficient buoyancy so that the unit can be used to keep personnel together in the water and to prevent them from becoming separated. In a preferred embodiment a sheet of liner material overlies the interior face of the rear section 14 to form a pocket in which the foam liner can be retained. It will be understood, however, that liner is not a critical component and that the foam sheet can be simply placed in the interior of the unit. It should be noted that not all of the life jackets may utilized and the remaining unused life jackets can be retained in the unit to provide additional buoyancy.

In an another embodiment of the safety storage system of this invention, an inflatable bladder, such as an inflatable type 4 throwable flotation device can be placed in the safety storage unit 10 to provide, when inflated, buoyancy to the safety storage unit 10. The bladder when non-inflated lies flat in the unit and does not reduce the storage capacity or interfere with the flexibility of the safety storage unit.

Figure 1:
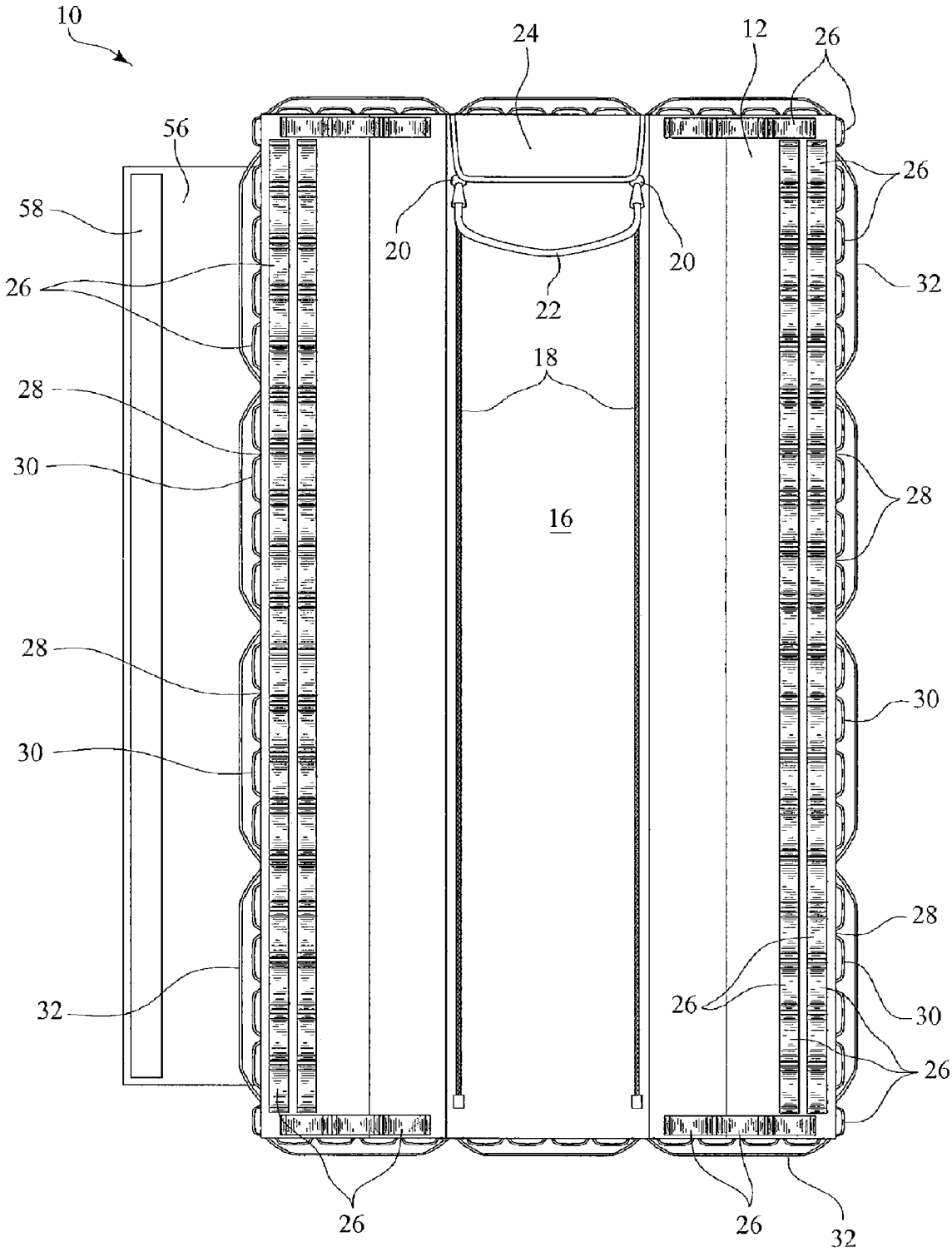
FIG. 1 is a view of the top section of the storage unit of the safety storage system.
Figure 2:
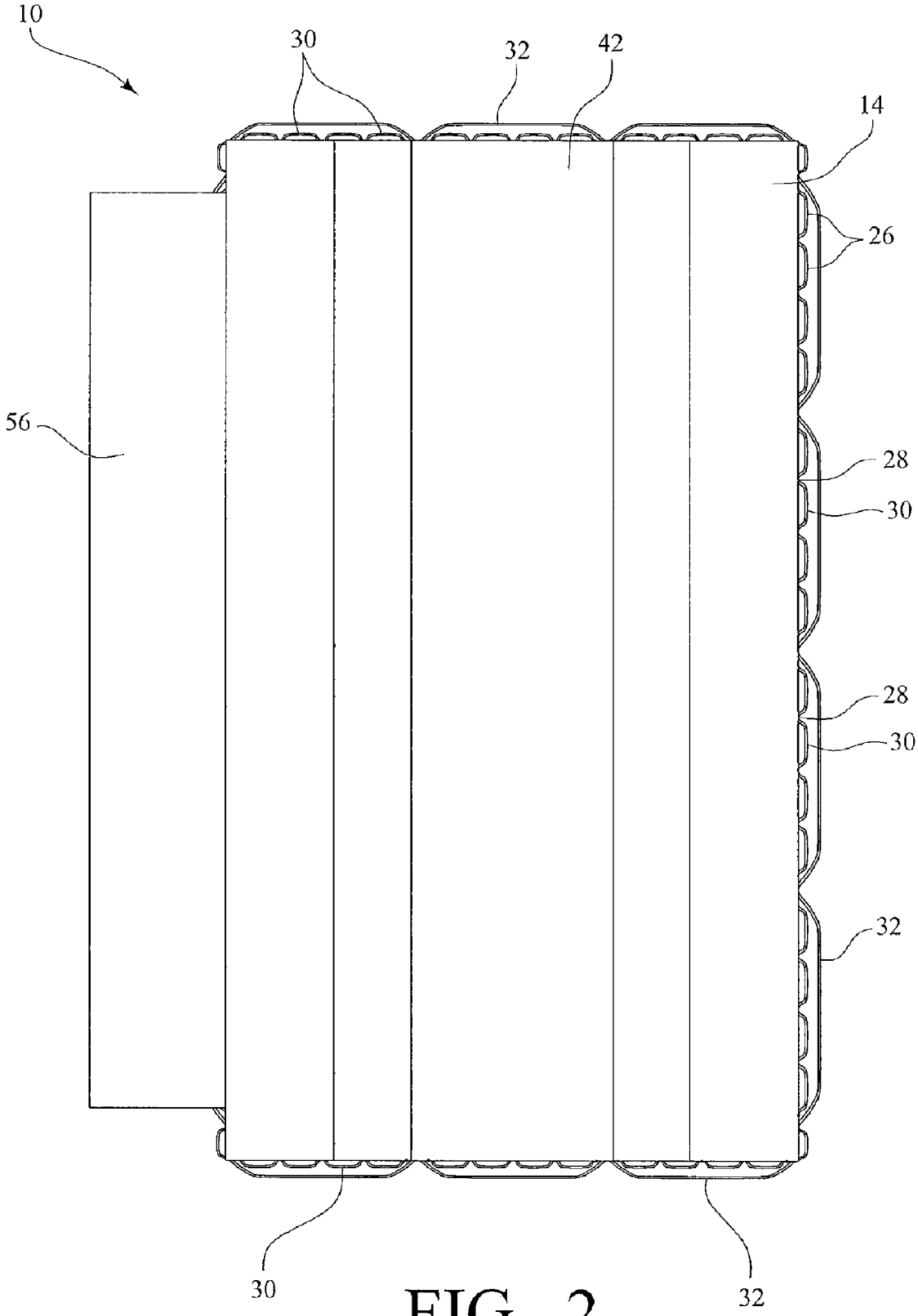
FIG. 2 is a view of the rear section of the unit of FIG. 1.
Figure 3:
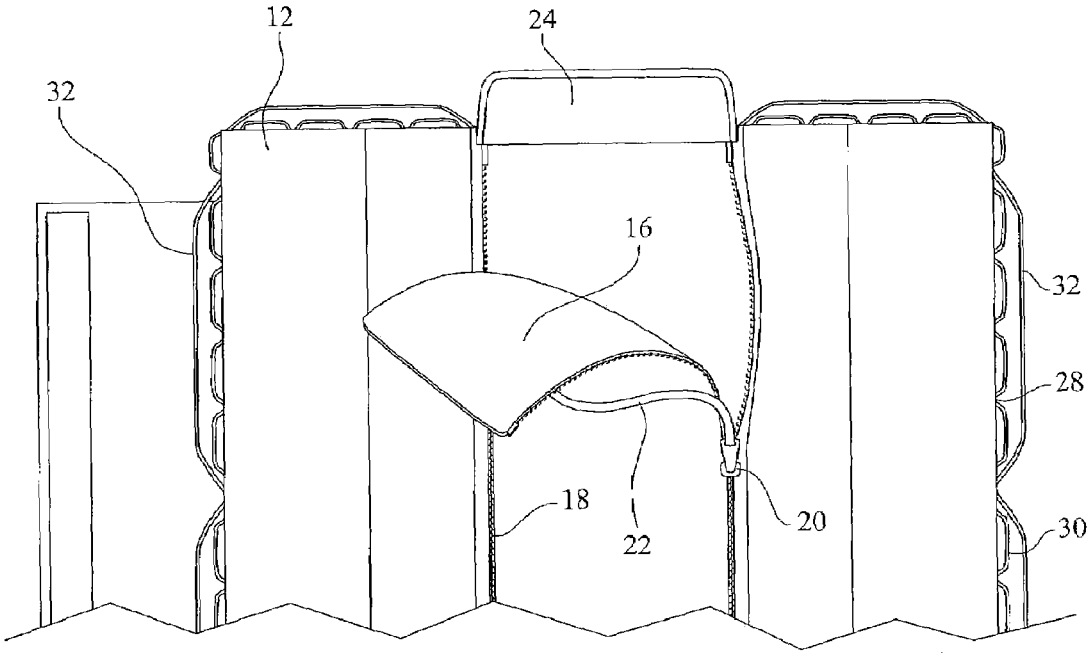
FIG. 3 is a view of the top section of the unit of FIG. 1 broken away for compactness of illustration and showing a portion of the panel on as it and folded back to expose the interior of the storage unit.

As illustrated by FIG. 2 strips 60 of brightly colored reflective tape or ribbon 42, such as 3M SOLAS (Safety Of Life At Sea) reflective tape, are affixed to sections 12 and 14 of the safety storage unit 10 for visibility from the air by rescue units. The panel 16 can also covered with the tape or ribbon 42 as an additional spotting aid.

Although primarily intended for overhead storage, it will be understood that some small craft do not have cockpit covers yet are faced with the same storage problems as discussed above. The multipurpose marine safety storage system of the present invention can function with good results for the storage of life jackets and the like by securing the storage unit 10 to stern or side rails, if present, or to tie down cleats normally present along the sides of the craft. The unit, being flexible, can be folded to occupy a relatively small area of the passenger compartment.

Under some circumstances small craft may be called upon to rescue individuals already in the water. In this situation the multipurpose marine safety storage system can be quickly detached from its storage location and the entire safety storage unit 10 can be thrown into the water to serve as a flotation device for individuals in the water. If the facing surface 12 is upright the unit 10 can be opened in the water and individual life jackets contained therein removed and worn by the individuals. Likewise the modular containers can be easily accessed and items such as a radio, flares and the like readily removed for use. Similarly the entire unit 10 can first be detached and thrown into the water in the event of a collision resulting in the rapid sinking of the craft. Individuals on board can abandon ship and swim to the multi-purpose safety storage unit 10 and open the panel 16 to obtain the stored life jackets. Likewise, the containers of flares and other safety equipment stored by the system are readily accessible even in the water.

Because of its flexibility the multipurpose marine storage system can be readily detached from its storage location, whether under the cockpit cover or other location on board and folded for storing in a secure area on board the craft or in a storage area on shore when the craft is not in use.

As will be understood by those skilled in the art, various arrangements which lie within the spirit and scope of the invention other than those described in detail in the specification will occur to such persons skilled in the art. It is therefor to be understood that the invention is to be limited only by the claims appended hereto.

What is claimed is:

1. A multipurpose marine safety storage system comprising a buoyant flexible safety storage unit having a facing section and a corresponding rear section that cooperate to define an interior there between, said facing and rear sections being joined at their respective edges, an elongated opening in said facing section for access to said interior of said unit, said opening being normally closed by an elongated panel overlying said opening, a quick release closure to secure said panel in its closed position over said opening and for rapid opening of said panel for access to the interior of the unit and a buoyant element to provide buoyancy for floatation of said safety storage unit.

2. The multipurpose marine safety storage system of claim 1 further including one or more attachment locations for securing containers to said safety storage unit.

3. The multipurpose marine safety storage system of claim 2 wherein at least one webbing strip adapted for the attachment of said containers is affixed to said safety storage unit, said webbing strip being secured to said safety storage unit at spaced apart intervals to form there between a plurality of unsecured sections defining attachment locations.

4. The multipurpose marine safety storage system of claim 3 wherein said webbing strip is affixed to said longitudinal and lateral edges and to said facing surface of said safety storage unit.

5. The multipurpose marine safety storage system of claim 4 wherein a pair of said webbing strips are affixed adjacent each of said longitudinal edges of said facing section.

6. The multipurpose marine safety storage system of claim 4 wherein a pair of said webbing strips are affixed adjacent each of said longitudinal edges of said facing section.

7. The multipurpose marine storage unit of claim 1 further including at least one longitudinal flap extending from a longitudinal edge of said unit, said flap being passed around a cockpit cover longitudinal support member for securing said longitudinal edge of said unit on the undersurface of said cockpit cover, said flap including a strip of hook and loop material for attachment to a corresponding strip of hook and loop material on said longitudinal edge from which said flap extends.

8. The multipurpose marine storage unit of claim 7 wherein said longitudinal flap is formed on the front longitudinal edge of said unit.

9. The multipurpose marine storage unit of claim 7 further including a longitudinal flap extending from both said front and said rear longitudinal edge of said unit.

10. The multipurpose marine storage unit of claim 1 further including a sheet of closed cell foam material placed in the interior of said unit therein to provide buoyancy for said unit.

11. The multipurpose marine storage unit of claim 1 further including an inflatable bladder in the interior of said unit thereby to provide buoyancy for said unit when said bladder is inflated.

12. The storage unit of claim 1 further including a liner in the interior overlying said rear section and containing a layer of flotation foam between said rear section and said liner.

13. The storage unit of claim 1 further including a strip of brightly colored reflective material on said rear section as a spotting aid when said unit is in water.

14. A multipurpose marine safety storage system comprising a flexible safety storage unit having a facing section and a corresponding rear section that cooperate to define an interior there between, said facing and rear sections being joined at their respective edges, an elongated opening in said facing section for access to said interior of said unit, said opening being normally closed by an elongated panel overlying said opening, a quick release closure to secure said panel in its closed position over said opening and for rapid opening of said panel for access to the interior of the unit, said multipurpose marine safety storage system further including at least one webbing strip adapted for the attachment of containers affixed to said safety storage unit, said webbing strip being secured to said safety storage unit at spaced apart intervals to form there between a plurality of unsecured sections defining attachment locations.

15. The multipurpose marine safety storage system of claim 14 wherein said webbing strip is affixed to said longitudinal and lateral edges and to said facing surface of said safety storage unit.

16. The multipurpose marine safety storage system of claim 15 wherein said attachment points comprise handholds disposed on said longitudinal and lateral edges of said safety storage unit for receiving portions of quick release straps.

17. The multipurpose marine safety storage system of claim 16 wherein said quick release straps secure said handholds to corresponding frame members of a cockpit cover for overhead securing of said system on the underside of a cockpit cover.

18. The multipurpose marine safety storage system of claim 15 wherein said securing straps are passed around frame members supporting a cockpit cover for overhead attachment of said safety storage unit on the underside of a cockpit cover.

19. The multipurpose marine safety storage system of claim 10 wherein said securing straps include a quick release mechanism, said securing straps being independent of said safety storage unit and said frame members of a cockpit cover.

20. The multipurpose marine safety storage system of claim 14 further including securing straps for securing said safety storage unit to a marine craft, said securing straps being independent of both said safety storage unit and a desired structure of said marine craft to which said safety storage unit is secured.

* * * * *